US006672446B2

(12) United States Patent
Boldrini et al.

(10) Patent No.: US 6,672,446 B2
(45) Date of Patent: Jan. 6, 2004

(54) UNIT AND METHOD FOR TRANSFERRING CIGARETTE PORTIONS

(75) Inventors: Fulvio Boldrini, Ferrara (IT); Salvatore Rizzoli, Bologna (IT)

(73) Assignee: G.D Societa' per Azinoi, Bologna (IT)

( * ) Notice: Subject to any disclaimer, the term of this patent is extended or adjusted under 35 U.S.C. 154(b) by 0 days.

(21) Appl. No.: 09/907,276

(22) Filed: Jul. 17, 2001

(65) Prior Publication Data

US 2002/0043269 A1 Apr. 18, 2002

(30) Foreign Application Priority Data

Jul. 21, 2000 (IT) ..... BO2000A0446

(51) Int. Cl.[7] ..... B65G 17/46

(52) U.S. Cl. ..... 198/471.1; 198/474.1; 198/476.1

(58) Field of Search ..... 198/471.1, 474.1, 198/476.1

(56) References Cited

U.S. PATENT DOCUMENTS 4,044,659 A * 8/1977 Bardenhagen et al. ... 198/474.1
4,506,779 A * 3/1985 Seragnoli ..... 198/459.1
4,645,063 A * 2/1987 Seragnoli ..... 198/450
4,697,691 A * 10/1987 Zodrow et al. ..... 198/418.5
4,804,079 A 2/1989 Hensgen et al.
4,823,536 A * 4/1989 Manservigi et al. ..... 198/476.1
4,827,948 A 5/1989 Schumacher
5,255,777 A * 10/1993 Pawelko ..... 198/450
5,267,577 A 12/1993 Rizzoli et al.

FOREIGN PATENT DOCUMENTS

GB 1469991 * 5/1974
GB 2 259 289 A 3/1993

* cited by examiner

*Primary Examiner*—Joseph E. Valenza
*Assistant Examiner*—Richard Ridley
(74) *Attorney, Agent, or Firm*—Marshall, Gerstein & Borun

(57) ABSTRACT

A unit and method for transferring cigarette portions whereby the cigarette portions are transferred from a manufacturing machine to a filter assembly machine by means of a first conveyor having first seats movable along a first annular path to pick up respective cigarette portions at a pickup point, and by means of a second conveyor having second seats movable along a respective second annular path; the cigarette portions are transferred from a first seat to a second seat at a transfer point along the first path, and the speed of the second seats is corrected at the transfer point to substantially reach or approximate the speed of the first seats at the transfer point.

26 Claims, 5 Drawing Sheets

UNIT AND METHOD FOR TRANSFERRING CIGARETTE PORTIONS

The present invention relates to a unit and method for transferring cigarette portions.

BACKGROUND OF THE INVENTION

Between a cigarette manufacturing machine and a filter assembly machine, a transfer unit is normally located to transfer to an input drum of the filter assembly machine the cigarette portions fed longitudinally in a first straight horizontal direction along a forming beam of the manufacturing machine.

Such units are known to comprise a first conveyor having a number of pickup heads, each of which travels along a first annular path about a first axis perpendicular to the first direction, and comprises a first seat for removing a cigarette portion off the forming beam and which is maintained parallel to the first direction as the head is fed along the first annular path.

The transfer unit also comprises a second conveyor rotating about a second axis parallel to the first direction and having a number of second seats parallel to and equally spaced about the second axis to receive the cigarette portions from respective first seats on the first conveyor at a transfer station.

The transfer unit described above is suitable for transferring cigarette portions from a single-rod manufacturing machine—i.e. a machine on which a single succession of cigarette portions is fed along the forming beam—to the input drum of a filter assembly machine.

The second conveyor of the above unit is normally a drum, the spacing of the second seats on the outer periphery of which is determined by the length of each filter paper, and therefore by the cigarette diameter and the design characteristics of the filter assembly machine, so that, for a given spacing of the second seats, the tangential speed of the second seats and, therefore, the diameter and angular rotation speed of the drum are directly proportional to the output (number of cigarettes per minute) required of the line defined by the manufacturing machine and the filter assembly machine as a whole.

The angular rotation speed of the first conveyor about the first axis is constant and depends on the ratio between the output required and the number of pickup heads on the first conveyor.

Each pickup head is normally fitted in rotary manner to an arm in turn fitted in rotary manner to the conveyor, and the constant-speed rotations of the conveyor and arms are coordinated so that each pickup head is fed along an elliptical annular first path.

The reason the pickup heads are fed along an elliptical as opposed to a circular path lies in the cigarette portions normally being fed longitudinally along the forming beam of the manufacturing machine at a much faster speed than that at which the cigarette portions are fed transversely by the second seats on the drum. An elliptical annular path, in fact, enables the pickup heads to be advanced at variable speed and to transfer the cigarette portions to the second seats at a different (lower) speed from that at which the cigarette portions are removed from the forming beam. More specifically, at best, the transfer speed should be approximately equal to but no less than the tangential speed of the second seats on the drum, and the pickup speed should be approximately equal to but no less than the speed at which the cigarette portions are fed longitudinally along the forming beam.

For a given output rate, two requirements must be borne in mind when designing the first conveyor and relative arms: one is to achieve as compact a conveyor as possible, and the other to achieve the best pickup and transfer speeds as explained above. Since the design of the first conveyor and relative arms, however, also depends on both the number of pickup heads and the required pickup and transfer speeds, it is often difficult if not impossible to meet both requirements satisfactorily within the above design limitations.

The problem is further compounded in the case of transfer units operating with so-called dual-rod manufacturing and filter assembly machines.

A transfer unit for dual-rod lines is described, for example, in Patent GB 2,259,289. In this case, the transfer unit is associated with a forming beam along which two parallel successions of cigarette portions are fed, and comprises a first conveyor having a number of pickup heads traveling along an elliptical path and in turn having two parallel first seats. The unit also comprises a second conveyor defined by a drum, which rotates at constant angular speed and has a first group of second seats formed in the outer skirt of the drum, and a second group of second seats formed on the ends of respective arms movable with respect to the drum, and alternating with the second seats in the first group. The second seats in the second group are movable between a conveying position adjacent to the outer skirt of the drum, and a receiving position to receive the cigarette portions from the pickup heads and in which they project with respect to the skirt.

In a transfer unit of this sort, the above design limitations result in a much faster speed of the first seats with respect to the second seats at the transfer station. Combined with the fact that the cigarette portions are severely decelerated axially during transfer, the difference in speed between the first and second seats results in transverse impact of the cigarette portions as they are transferred from the first to the second seats, and in tobacco fallout from the ends of the cigarette portions.

The problem is further compounded as regards the seconds seats in the first group, by the peripheral speed of these being slower than the second seats in the second group in the receiving position.

Another transfer unit for dual-rod lines is described in U.S. Pat. No. 5,267,577. In this case, the unit comprises a second conveyor defined by a cage roller housing a drum; the second seats in the first group are locatd on the drum, and the second seats in the second group on the cage roller; and the ratio of the drum and cage roller rotation speeds is inversely proportional to the ratio of the respective radii, so that the peripheral speed of the first group of second seats is equal to the peripheral speed of the second group of second seats.

A transfer unit of this sort has the advantage of the second seats in the first and second groups traveling at the same peripheral speed at the transfer station. On the other hand, the design limitations referred to in connection with single-rod lines are even more stringent in this case, by the elliptical shape of the annular path having to be so designed as to prevent the trajectories of the first seats on the first conveyor and the second seats on the second conveyor from intersecting each other.

In this case, too, therefore, the above design limitations result in a much faster speed of the first seats with respect to the second seats at the transfer station. And as stated previously, combined with the fact that the cigarette portions are severely decelerated axially during transfer, the difference in speed between the first and second seats results in transverse impact of the cigarette portions as they are transferred from the first to the second seats, and in tobacco fallout from the ends of the cigarette portions.

SUMMARY OF THE INVENTION

It is an object of the present invention to provide a unit for transferring cigarette portions, designed to eliminate the drawbacks of the known state of the art.

According to the present invention, there is provided a unit for transferring cigarette portions from a manufacturing machine to a filter assembly machine; the unit comprising a first conveyor having a number of first seats movable along a first annular path about a first axis to pick up respective cigarette portions at a given pickup point along the first path; and a second conveyor having at least one number of second seats movable along a respective second annular path about a second axis perpendicular to the first axis; each said second seat receiving a cigarette portion from a said first seat at a transfer point along said first path; and the unit being characterized in that, for at least one said number of second seats, each second seat is located at the end of an arm which is movable to correct the speed of the second seats to substantially reach or approximate the speed of the first seats at said transfer point.

The present invention also relates to a method of transferring cigarette portions.

According to the present invention, there is provided a method of transferring cigarette portions from a manufacturing machine to a filter assembly machine by means of a transfer unit comprising a first conveyor having a number of first seats movable along a first annular path about a first axis to pick up respective cigarette portions at a given pickup point along the first path, and a second conveyor having at least one number of second seats movable along a respective second annular path about a second axis perpendicular to the first axis; the method providing for feeding each said second seat about said second axis, and transferring a cigarette portion from a first seat to a second seat at a transfer point along said first path; and the method being characterized by correcting, for at least one said number of second seats, the speed of the second seats so as to substantially reach or approximate the speed of the first seats at the transfer point.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
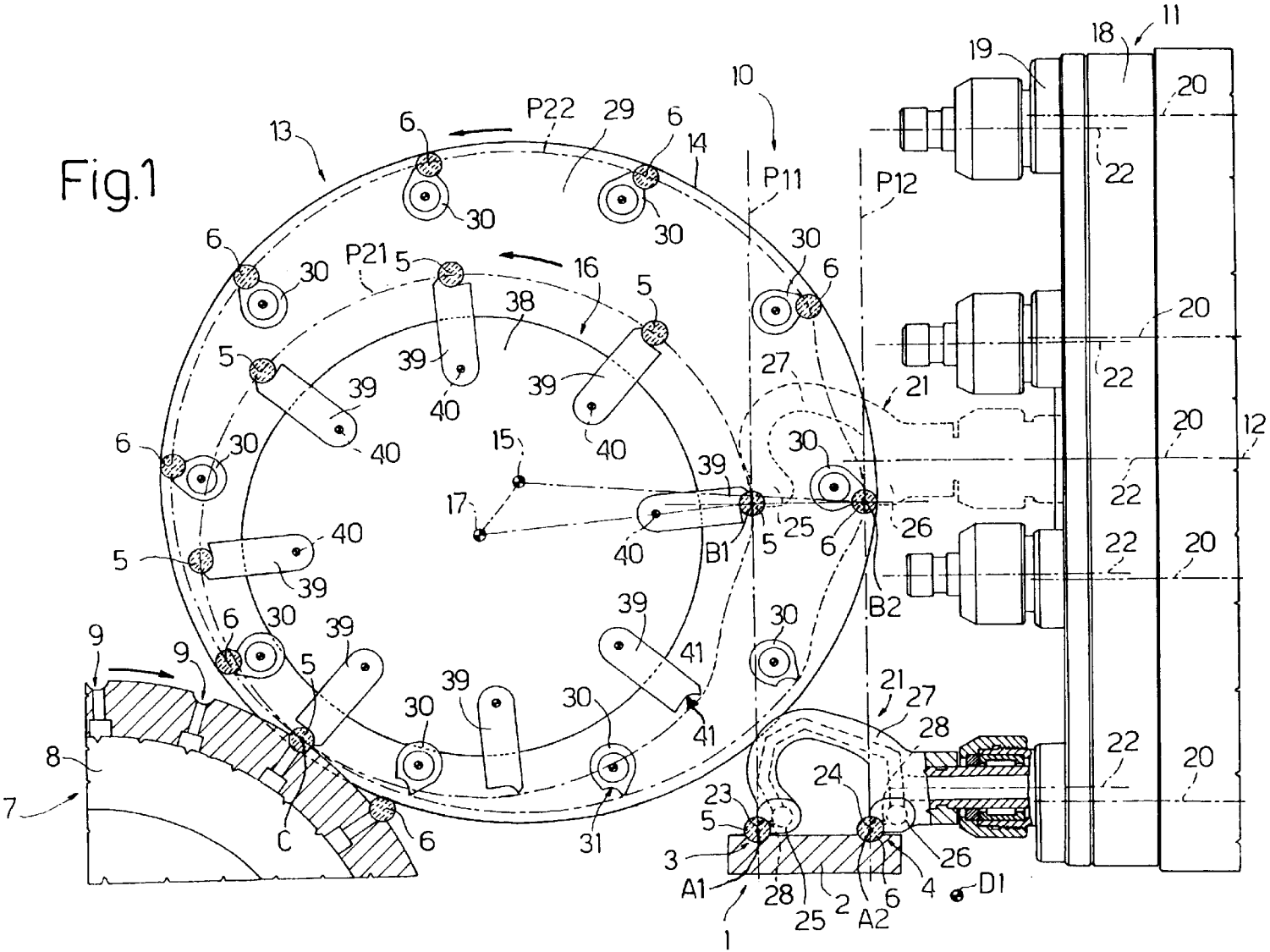
FIG. 1 shows a partly sectioned side view, with parts removed for clarity, of a transfer unit in accordance with a preferred embodiment of the present invention.

Number 1 in FIG. 1 indicates as a whole a dual-rod cigarette manufacturing machine of the type described and illustrated in U.S. Pat. No. 4,418,705, to which full reference is made herein for the sake of clarity. Machine 1 comprises a forming beam 2 along which two parallel successions 3 and 4 of cigarette portions 5 and 6 are fed at equal substantially constant axial speeds in a direction D1.

Number 7 in FIG. 1 indicates as a whole a filter assembly machine, an input drum 8 of which, having respective seats 9 for housing portions 5 and 6, is connected to forming beam 2 of machine 1 by a transfer unit indicated as a whole by 10 and for transferring portions 5 and 6 successively from beam 2 to drum 8 of machine 7.

Unit 10 comprises a first conveyor 11 located over beam 2 and rotating about an axis 12 perpendicular to direction D1; and a second conveyor 13 in turn comprising a cage roller 14 rotating about an axis 15 perpendicular to axis 12, and a drum 16 housed inside cage roller 14 and rotating about an axis 17 parallel to and offset with respect to axis 15.

Conveyor 11 comprises a platform 18 rotating at constant speed about axis 12; a number of arms 19 equally spaced about axis 12 and rotating, with respect to platform 18, at constant speed about respective axes 20 parallel to axis 12; and a number of pickup heads 21, each of which is mounted for rotation on a respective arm 19 to rotate about an axis 22 parallel to axis 12, and has seats 23 and 24 for housing portions 5 and 6 respectively. On each head 21, seat 23 is formed along a rib 25, and seat 24 along a rib 26 parallel to rib 25 and connected to rib 25 by an arc 27; and ribs 25 and 26 have suction holes 28 for retaining portions 5 and 6 inside respective seats 23 and 24.

Figure 2:
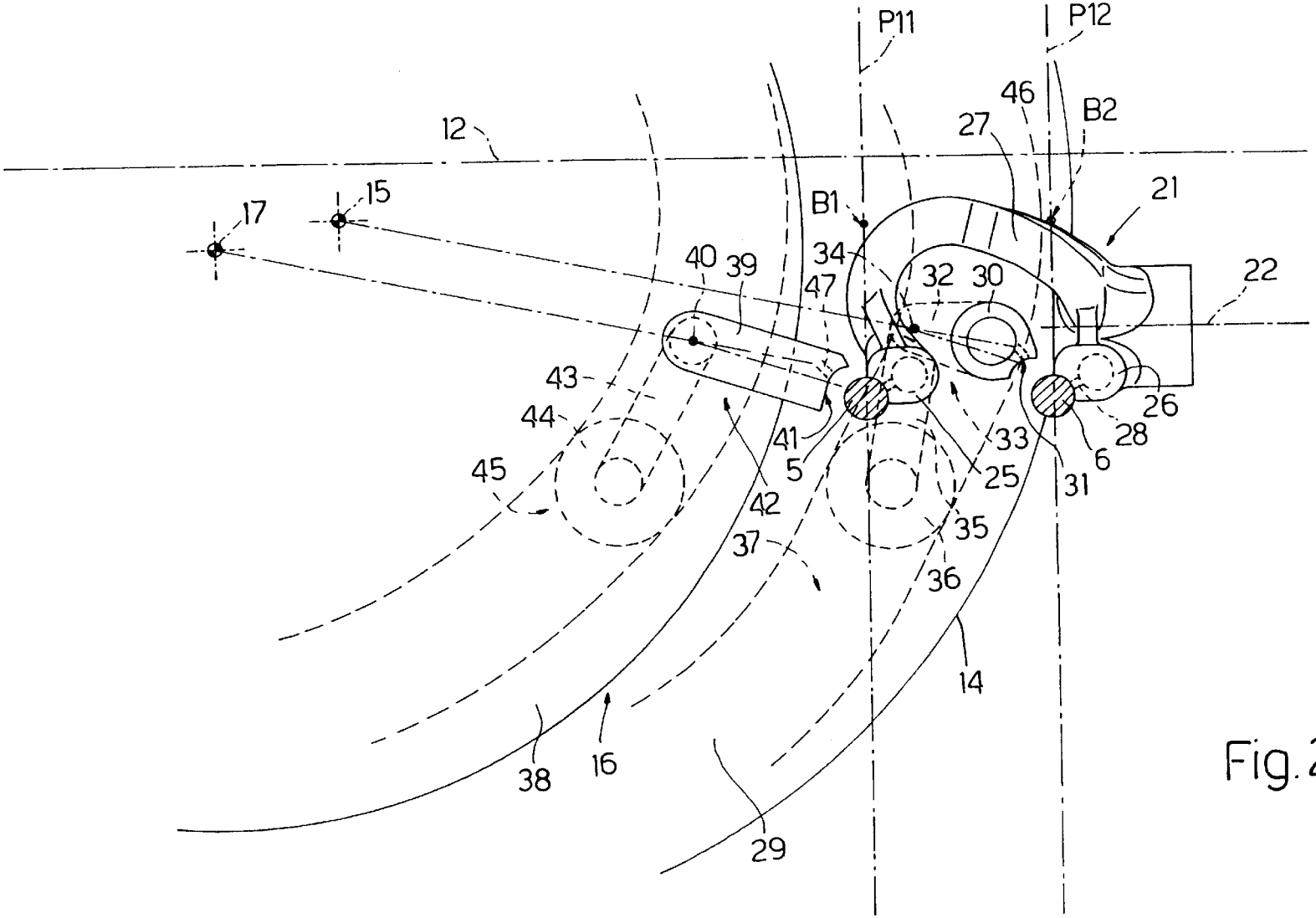
FIGS. 2 to 4 show larger-scale, schematic side views, with parts removed for clarity, of successive steps in the operation of the FIG. 1 unit.

With reference to FIGS. 1 and 2, cage roller 14 comprises a cylindrical platform 29 rotating at constant speed about axis 15; and a number of ribs 30, each of which is parallel to axis 15, has a respective seat 31 for housing a portion 6, and is fitted to the end of an arm 32 of a rocker arm 33 hinged to platform 29 about an axis 34 parallel to axis 15. Rocker arm 33 comprises a lever 35 fitted on the end with a tappet 36 guided by a fixed annular track 37.

Drum 16 comprises a cylindrical body 38 rotating at constant speed about axis 17 and having a number of arms 39 equally spaced about axis 17 and hinged about respective axes 40 parallel to axis 17. Each arm 39 has a seat 41 at the free end, and defines a portion of a rocker arm 42 comprising a lever 43 fitted on the end with a tappet 44, which is guided by a fixed annular track 45 for guiding tappets 44 and orienting respective arms 39. Ribs 30 and arms 39 have respective suction holes 46 and 47 for retaining portions 6 and 5 inside respective seats 31 and 41.

With reference to FIG. 1, in actual use, platform 18 is rotated at constant speed about axis 12, arms 19 are rotated about axes 20, and heads 21 are rotated about axes 22 to feed seats 23 and 24 along respective parallel elliptical paths P11 and P12, along which, seats 23 and 24 pick up respective portions 5 and 6 off beam 2 at given points A1 and A2 of respective paths P11 and P12, and release portions 5 and 6 to seats 41 and 31 at respective points B1 and B2 of respective paths P11 and P12.

Cage roller 14 and drum 16 are rotated anticlockwise in FIG. 1 about respective axes 15 and 17, and respective seats 31 and 41 are fed along respective annular paths P22 and P21, which are circular, except for portions at transfer points B1 and B2, and are tangent to drum 8 at a point C where seats 41 and 31 release portions 5 and 6 to seats 9 on drum 8. More specifically, at point C, the surface speeds of seats 31 and 41 are equal, by the ratio between the angular speeds of cage roller 14 and drum 16 being inversely proportional to the ratio between the distance of seat 31 from axis 15 and the distance of seat 41 from axis 17.

Figure 3:
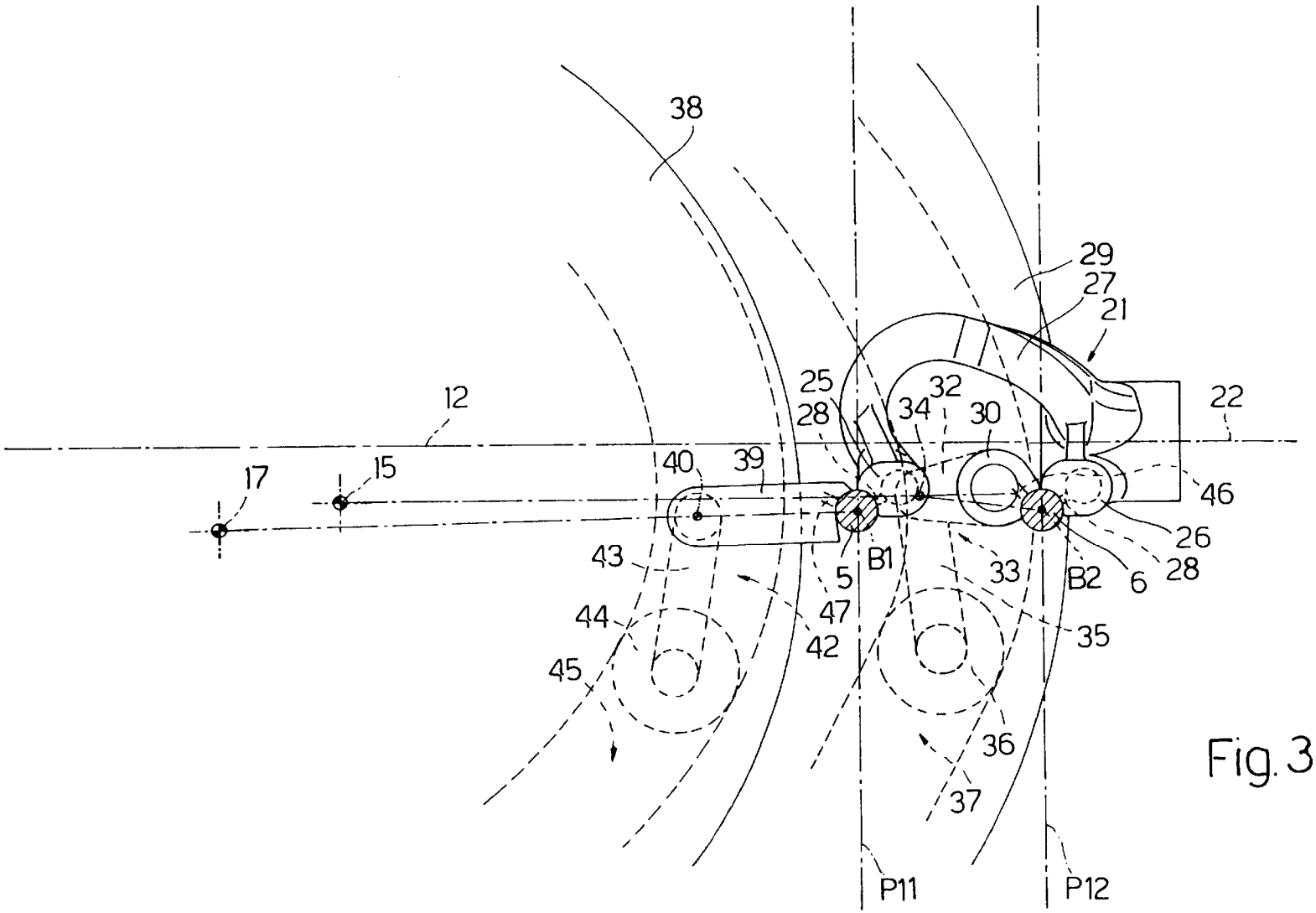
Figure 4:
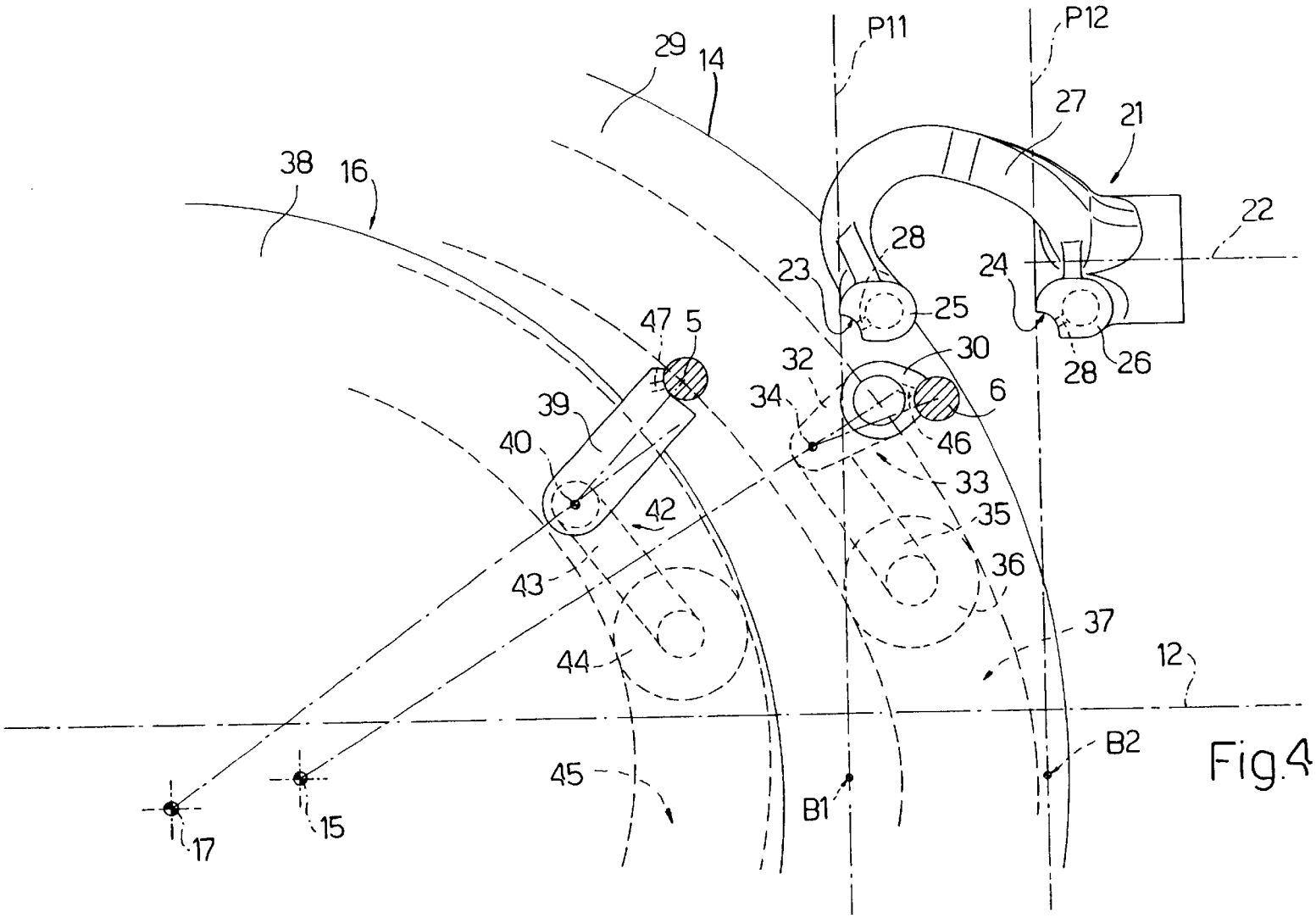

As shown more clearly in FIGS. 2, 3 and 4, arms 32 and 39 are only rotated about respective axes 34 and 40 at a zone close to points B1 and B2. More specifically, arm 32 remains in a fixed position with respect to platform 29 for most of a complete turn, and, as it nears transfer point B2, undergoes a speed correction and successively performs an anticlockwise rotation about axis 34 to so position rib 30 as to avoid a collision with rib 25 on head 21; a clockwise rotation about axis 34 to slow down seat 31; and an anticlockwise rotation to accelerate seat 31 at point B2 so that the speed of seat 31 at point B2 is approximately equal to but no greater than the speed of seat 24. Once seat 31 passes point B2, arm 32 is again rotated clockwise to so position rib 30 as to prevent a collision with rib 25 on head 21, and, once rib 30 moves away from head 21, seat 31 is again rotated anticlockwise back into the initial position.

In substantially the same way, arm 39 remains in a fixed position with respect to cylindrical body 38 for most of a complete turn, and, as it nears transfer point B1, undergoes a speed correction and successively performs a clockwise rotation about axis 40 to slow down seat 41, and an anticlockwise rotation to accelerate seat 41 at point B1 so that the speed of seat 41 at point B1 is approximately equal to but no greater than the speed of seat 23. Once seat 41 passes point B1, arm 39 is rotated clockwise back into the initial position.

In other words, the two annular tracks 37 and 45 are so formed as to decelerate and accelerate seats 31 and 41 upstream from respective transfer points B2 and B1; and annular track 37 is so formed that seats 31 are accelerated and then decelerated upstream from transfer point B2, and are decelerated and then accelerated downstream from transfer point B2.

Figure 5:
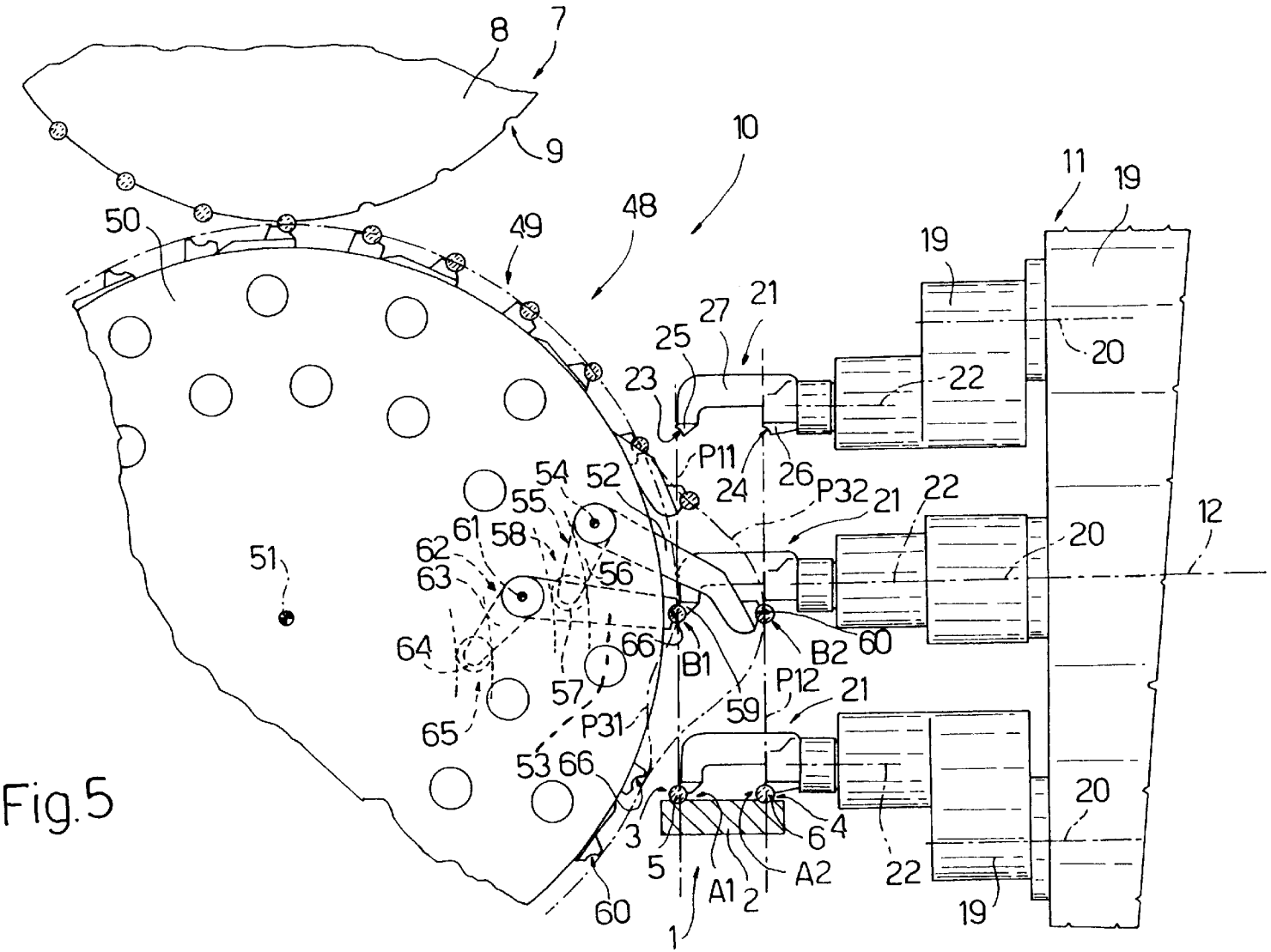
FIG. 5 shows a partly sectioned side view, with parts removed for clarity, of a variation of the FIG. 1 transfer unit.

In the FIG. 5 variation, conveyor 13 is replaced with a conveyor 48 comprising a drum 49 having a cylindrical body 50, which rotates anticlockwise in FIG. 5 at constant speed about an axis 51 parallel to direction D1, and supports a number of arms 52 equally spaced about axis 51, and a number of arms 53 equally spaced about axis 51 and alternating with arms 52.

Each arm 52 is mounted for rotation about an axis 54 and defines part of a rocker arm 55, which comprises a lever 56 fitted on the end with a tappet 57 running along a fixed track 58 with respect to cylindrical body 50. Arm 52 supports a rib 59 in which is formed a seat 60 having suction holes not shown. Similarly, each arm 53 is mounted for rotation about an axis 61 and defines part of a rocker arm 62, which comprises a lever 63 fitted on the end with a tappet 64 running along a fixed track 65 with respect to cylindrical body 50. A seat 66 having suction holes not shown is formed on the end of arm 53.

In actual use, conveyor 48 differs from conveyor 13 by each arm 52 being set to a rest position along the outer surface of cylindrical body 50 so that respective seat 60 is located between two seats 66 for most of a full turn of cylindrical body 50, whereas, at point B2, arm 52 is extended so that seat 60 is located along a hypothetical straight line through axis 51 and an adjacent seat 66. In other words, seats 60 are fed about axis 51 along an annular path P32, which is circular with an outwardly convex portion at transfer point B2. The profile of track 58 is such as to accelerate seat 60 at point B2, so that the speed of seat 60 at point B2 is approximately equal to but no greater than the speed of seat 24, and to decelerate seat 60 once past point B2.

Each arm 53 remains fixed for most of a complete turn of cylindrical body 50, and is rotated clockwise about axis 61 upstream from point B1, and then anticlockwise about axis 61 at point B1, so that seat 66 is decelerated upstream from point B1, and is then accelerated to a surface speed approximately equal to but no greater than the speed of seat 23 at point B1.

Like unit 10 in FIG. 1, the profile of track 65 is such that seat 66 is fed along a circular path P31 having an outwardly convex portion upstream from point B1.

In other words, annular tracks 58 and 65 are so formed that seats 60 are accelerated upstream and decelerated downstream from transfer point B2, and seats 66 are decelerated and then accelerated directly upstream from transfer point B1.

In this case, too, on passing point B1, seat 66 is restored to the initial position by rotating arm 53 clockwise.

Unlike unit 10 in FIG. 1, paths P31 and P32 are in fact coincident except for the region about points B1 and B2.

The concept of correcting the speed of each receiving seat to substantially reach or approximate the speed of the respective releasing seat provides for eliminating the drawbacks of the known state of the art by permitting greater freedom in the design of first conveyor 11. What is more, though particularly important in the case of dual-rod lines, the same concept also applies to transfer units operating between a single-rod manufacturing machine and a filter assembly machine.

What is claimed is:

1. A unit for transferring cigarette portions (5, 6) from a manufacturing machine (1) to a filter assembly machine (7); the unit (10) comprising a first conveyor (11) having a number of first seats (23, 24) movable along a first annular path (P11, P12) about a first axis (12) to pick up respective cigarette portions (5, 6) at a given pickup point (A1, A2) along the first path (P11, P12); and a second conveyor (13; 48) having at least one number of second seats (31, 41; 60, 66) movable along a respective second annular path (P22, P21; P32, P31) about a second axis (15, 17; 51) perpendicular to the first axis (12); each said second seat (31, 41; 60, 66) receiving a cigarette portion (5, 6) from a said first seat (23, 24) at a transfer point (B1, B2) along said first path (P11, P12); for at least one said number of second seats (31, 41; 60, 66), each second seat (31, 41; 60, 66) being located at the end of a respective arm (32, 39; 52, 53) which is movable to correct the speed of the second seats (31, 41; 60, 66) to substantially reach or approximate the speed of the first seats (23, 24) at said transfer point (51, 52); each said arm (32, 39; 52, 53) being movable to increase the speed of the respective said second seat (31, 41; 60, 66) at said transfer point (B1, B2) to substantially reach or approximate the speed of the corresponding said first seat (23, 24) at said transfer point (B1, B2).

2. The unit of claim 1 wherein each arm (32, 39; 52, 53) rotates about a respective third axis (34, 40; 54, 61) parallel to said second axis (15, 17; 51); said transfer unit (10) comprising actuating means for activating said arms (32, 39; 52, 53).

3. The unit of claim 2 wherein said actuating means comprise, for each second seat (31, 41; 60, 66), a rocker arm (33, 42; 55, 62) rotating about said third axis (34, 40; 54, 61), and a tappet (36, 44; 57, 64); said second conveyor (13; 48) comprising at least one annular track (37, 45; 58, 65) for guiding said tappet (36, 44; 57, 64).

4. The unit of claim 3 wherein each said arm (32, 39; 52, 53) forms part of a relative said rocker arm (33, 42; 55, 62).

5. The unit of claim 4 wherein said second conveyor (13; 48) is rotated about said second axis (15, 17; 51) in a given rotation direction; said annular track (37, 45; 58, 65) being so formed as to rotate each said arm (32, 39; 52, 53) about the respective third axis (34, 40; 54, 61) in the same rotation direction as the second conveyor (13; 48) at said transfer point (B1, B2).

6. The unit of claim 1 wherein said first conveyor (11) comprises a first group of first seats (23) and a second group of first seats (24); each first seat (23) in the first group being side by side with a first seat (24) in the second group and supported by a head (21) common to said first seat (23) in the first group and to said first seat (24) in the second group.

7. The unit of claim 6 wherein said second conveyor (13) comprises a drum (16) having a first group of second seats (41) for receiving the cigarette portions (5) from the first seats (23) in the first group at a first transfer point (B1); and a cage roller (14) surrounding said drum (16) and having a second group (31) of second seats for receiving the cigarette portions (6) from the first seats (24) in the second group at a second transfer point (52); said second conveyor (13) comprising two annular tracks (37, 45) so formed that said second seats (41, 31) in the first and second group are accelerated at the first and second transfer point (B1, B2) respectively.

8. A unit of for transferring cigarette portions (5, 6) from a manufacturing machine (1) to a filter assembly machine (7); the unit (10) comprising a first conveyor (11) having a number of first seats (23, 24) movable along a first annular path (P11, P12) about a first axis (12) to pick up respective cigarette portions (5, 6) at a given pickup point (A1, A2) along the first path (P11, P12); and a second conveyor (13; 48) having at least one number of second seats (31, 41; 60, 66) movable along a respective second annular path (P22, P21; P32, P31) about a second axis (15, 17; 51) perpendicular to the first axis (12); each said second seat (31, 41; 60, 66) receiving a cigarette portion (5, 6) from a said first seat (23, 24) at a transfer point (51, 52) along said first path (P11, P12); for at least one said number of second seats (31, 41; 60, 66), each second seat (31, 41; 60, 66) being located at the end of a respective arm (32, 39; 52, 53) which is movable to correct the speed of the second seats (31, 41; 60, 66) to substantially reach or approximate the speed of the first seats (23, 24) at said transfer point (51, 52); said first conveyor (11) comprising a first group of first seats (23) and a second group of first seats (24); each first seat (23) in the first group being side by side with a first seat (24) in the second group and supported by a head (21) common to said first seat (23) in the first group and to said first seat (24) in the second group; said second conveyor (13) comprising a drum (16) having a first group of second seats (41) for receiving the cigarette portions (5) from the first seats (23) in the first group at a first transfer point (B1); and a cage roller (14) surrounding said drum (16) and having a second group (31) of second seats for receiving the cigarette portions (6) from the first seats (24) in the second group at a second transfer point (B2); said second conveyor (13) comprising two annular tracks (37, 45) so formed that said second seats (41, 31) in the first and second group are accelerated at the first and second transfer point (B1, B2) respectively.

9. The unit of claim 8 wherein each arm (32, 39; 52, 53) rotates about a respective third axis (34, 40; 54, 61) parallel to said second axis (15, 17; 51); said transfer unit (10) comprising actuating means for activating said arms (32, 39; 52, 53).

10. The unit of claim 9 wherein said actuating means comprise, for each second seat (31, 41; 60, 66), a rocker arm (33, 42; 55, 62) rotating about said third axis (34, 40; 54, 61), and a tappet (36, 44; 57, 64); said second conveyor (13; 48) comprising at least one annular track (37, 45; 58, 65) for guiding said tappet (36, 44; 57, 64).

11. The unit of claim 10 wherein each said arm (32, 39; 52, 53) forms part of a respective said rocker arm (33, 42; 55, 62).

12. The unit of claim 11 wherein said second conveyor (13; 48) is rotated about said second axis (15, 17; 51) in a given rotation direction; said annular track (37, 45; 58, 65) being so formed as to rotate each said arm (32, 39; 52, 53) about the respective third axis (34, 40; 54, 61) in the same rotation direction as the second conveyor (13; 48) at said transfer point (51, 52).

13. The unit of claim 8 wherein said two annular tracks (37, 45) are so formed that said second seats (41, 31) in the first and second group are decelerated and accelerated upstream from the respective transfer points (51, 52).

14. The unit of claim 13 wherein said second conveyor (13) comprises an annular track (37) so formed that said second seats (31) in the second group are accelerated and decelerated upstream from said second transfer point (52).

15. The unit of claim 14 wherein said second conveyor (13) comprises an annular track (37) so formed that said second seats (31) in the second group are decelerated and accelerated downstream from said second transfer point (52).

16. The unit of claim 8 wherein said second conveyor (48) comprises a drum (49) having a third group of second seats (66) for receiving the cigarette portions (5) from the first seats (23) in the first group at a first transfer point (B1), and a fourth group of second seats (60) for receiving the cigarette portions (6) from the first seats (24) in the second group at a second transfer point (52); said second conveyor (48) comprising two annular tracks (58, 65) so formed that said second seats (60) in the fourth group are accelerated upstream and decelerated downstream from the second transfer point (52), and the second seats (66) in the third group are decelerated and then accelerated directly upstream from the first transfer point (B1).

17. A method of transferring cigarette portions (5, 6) from a manufacturing machine (1) to a filter assembly machine (7) by means of a transfer unit (10) comprising a first conveyor (11) having a number of first seats (23, 24) movable along a first annular path (P11, P12) about a first axis (12) to pick up respective cigarette portions (5, 6) at a given pickup point (A1, A2) along the first path (P11, P12), and a second conveyor (13; 48) having at least one number of second seats (31, 41; 60, 66) movable along a respective second annular path (P22, P21; P32, P31) about a second axis (15, 17; 51) perpendicular to the first axis (12); the method providing for feeding each said second seat (31, 41; 60, 66) about said second axis (15, 17; 51), and transferring a cigarette portion (5, 6) from a first seat (23, 24) to a second seat (31, 41; 60, 66) at a transfer point (51, 52) along said first path (P11, P12); for at least one said number of second seats (31, 41; 60, 66), the speed of the second seats (31, 41; 60, 66) being corrected so as to substantially reach or approximate the speed of the first seats (23, 24) at the transfer point (B1, B2); the speed of said second seats (31, 41; 60, 66) being increased at said transfer point (B1, B2) so as to substantially reach or approximate the speed of the first seats (23, 24) at the transfer point (B1, B2).

18. The method of claim 17 wherein each said second seat (31, 41; 60, 66) is formed on the end of a respective arm (32; 39; 52, 53); the method rotating each arm (32, 39; 52, 53) about a relative third axis (34, 40; 54, 61) parallel to said second axis (15, 17; 51).

19. The method of claim 18 wherein said second conveyor (13; 48) is rotated about said second axis (15, 17; 51) in a given rotation direction, and rotating said arms (32, 39; 52, 53) about said relative third axis (34, 40; 54, 61) in the same rotation direction as the second conveyor (13; 48) at said transfer point (B1, B2).

20. The method of claim 17 wherein said first conveyor (11) comprises a first group of first seats (23) and a second group of first seats (24); each first seat (23) in the first group being side by side with a first seat (24) in the second group and supported by a head (21) common to said first seat (23) in the first group and to said first seat (24) in the second group.

21. The method claim 20 wherein said second conveyor (13) comprises a drum (16) having a first group of second seats (41) for receiving the cigarette portions (5) from the first seats (23) in the first group at a first transfer point (B1); and a cage roller (14) surrounding said drum (16) and having a second group (31) of second seats for receiving the cigarette portions (6) from the first seats (24) in the second group at a second transfer point (52); the method accelerating said second seats (41, 31) in the first and second group at the first and second transfer point (B1, B2).

22. A method of transferring cigarette portions (5, 6) from a manufacturing machine (1) to a filter assembly machine (7) by means of a transfer unit (10) comprising a first conveyor (11) having a number of first seats (23, 24) movable along a first annular path (P11, P12) about a first axis (12) to pick up respective cigarette portions (5, 6) at a given pickup point (A1, A2) along the first path (P11, P12), and a second conveyor (13; 48) having at least one number of second seats (31, 41; 60, 66) movable along a respective second annular path (P22, P21; P32, P31) about a second axis (15, 17; 51) perpendicular to the first axis (12); the method providing for feeding each said second seat (31, 41; 60, 66) about said second axis (15, 17; 51), and transferring a cigarette portion (5, 6) from a first seat (23, 24) to a second seat (31, 41; 60, 66) at a transfer point (B1, B2) along said first path (P11, P12); for at least one said number of second seats (31, 41; 60, 66), the speed of the second seats (31, 41; 60, 66) being corrected so as to substantially reach or approximate the speed of the first seats (23, 24) at the transfer point (B1, B2); said first conveyor (11) comprising a first group of first seats (23) and a second group of first seats (24); each first seat (23) in the first group being side by side with a first seat (24) in the second group and supported by a head (21) common to said first seat (23) in the first group and to said first seat (24) in the second group; said second conveyor (13) comprising a drum (16) having a first group of second seats (41) for receiving the cigarette portions (5) from the first seats (23) in the first group at a first transfer point (B1); and a cage roller (14) surrounding said drum (16) and having a second group (31) of second seats for receiving the cigarette portions (6) from the first seats (24) in the second group at a second transfer point (B2); the method accelerating said second seats (41, 31) in the first and second group at the first and second transfer point (B1, B2).

23. The method of claim 22 wherein said second seats (41, 31) in the first and second group are accelerated and decelerated upstream from the respective first and second transfer point (B1, B2).

24. The method of claim 22 wherein said second seats (31) are accelerated and decelerated in the second group upstream from said second transfer point (B2).

25. The method of claim 22 wherein said second seats (31) in the second group are accelerated and decelerated downstream from said second transfer point (B2).

26. The method of claim 22 wherein second conveyor (48) comprises a drum (49) having a third group of second seats (66) for receiving the cigarette portions (5) from the first seats (23) in the first group at a first transfer point (B1), and a fourth group of second seats (60) for receiving the cigarette portions (6) from the first seats (24) in the second group at a second transfer point (52); said method providing for said second seats (60) in the fourth group being accelerated upstream and decelerated downstream from the second transfer point (B2), and for the second seats (66) in the third group being decelerated and then accelerated directly upstream from the first transfer point (B1).

* * * * *